US006837592B1

(12) United States Patent
Dahlen

(10) Patent No.: US 6,837,592 B1
(45) **Date of Patent: *Jan. 4, 2005**

(54) INDIRECT LUMINAIRE OPTICAL SYSTEM

(75) Inventor: Kevin S. Dahlen, Fontana, CA (US)

(73) Assignee: Genlyte Thomas Group, LLC, Louisville, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/341,109

(22) Filed: Jan. 13, 2003

Related U.S. Application Data

(63) Continuation-in-part of application No. 09/826,617, filed on Apr. 5, 2001, now Pat. No. 6,505,953.
(60) Provisional application No. 60/195,091, filed on Apr. 6, 2000.

(51) Int. Cl.[7] ..... F21S 3/00
(52) U.S. Cl. ..... 362/217; 362/224; 362/298; 362/301
(58) Field of Search ..... 362/217, 260, 362/223, 224, 225, 147, 335, 346, 297, 298, 301

(56) References Cited

U.S. PATENT DOCUMENTS

| | | | | |
|---|---|---|---|---|
| 4,388,675 | A | 6/1983 | Lewin | |
| 4,747,027 | A | 5/1988 | Rieger | |
| 4,939,627 | A | 7/1990 | Herst et al. | |
| 4,974,137 | A | 11/1990 | Evans, Jr. et al. | |
| 5,075,827 | A | 12/1991 | Smith | |
| 5,521,801 | A | 5/1996 | Pesau et al. | |
| 5,823,656 | A | 10/1998 | Waldmann | |
| 5,865,528 | A | 2/1999 | Compton et al. | |
| 5,884,993 | A | 3/1999 | Conn | |
| 6,042,246 | A | 3/2000 | Waldmann | |
| 6,247,828 | B1 | 6/2001 | Herst | |
| 6,505,953 | B1 * | 1/2003 | Dahlen | 362/217 |

FOREIGN PATENT DOCUMENTS

GB 2 215 447 A 9/1989

* cited by examiner

*Primary Examiner*—John Anthony Ward
(74) *Attorney, Agent, or Firm*—James E. Cole; Middleton Reutlinger

(57) ABSTRACT

An indirect luminaire optical system having linear tubular lamps, parabolic reflector assemblies positioned under the lamps, kick reflectors positioned adjacent to the sides of the lamps, and a housing positioned around the lamps and reflectors, with the housing having a substantially open top for allowing light to exit the optical system. Each parabolic reflector assembly may have a pair of substantially parabolic shaped reflectors joined to form a apex along and directly under the corresponding lamp lamp. The kick reflectors may be in a spaced relationship with the parabolic reflector assemblies, thereby defining openings therebetween. The bottom portion of the housing may have translucent areas which are in optical communication with the lamp through the openings.

15 Claims, 14 Drawing Sheets

INDIRECT LUMINAIRE OPTICAL SYSTEM

CROSS-REFERENCE TO RELATED APPLICATIONS

This application is a Continuation-in-Part of U.S. application Ser. No. 09/826,617, filed Apr. 5, 2001 now U.S. Pat. No. 6,505,953, issued Jan. 14, 2003, which claimed the benefit of U.S. Provisional Application No. 60/195,091, filed Apr. 6, 2000.

STATEMENT REGARDING FEDERALLY SPONSORED RESEARCH OR DEVELOPMENT

Not applicable.

REFERENCE TO A "SEQUENTIAL LISTING," A TABLE, OR A COMPUTER PROGRAM LISTING APPENDIX SUBMITTED ON A COMPACT DISC

Not applicable.

BACKGROUND OF THE INVENTION

1. Field of the Invention

The present invention relates to lighting fixtures for indirect room illumination through reflection of most of the fixture's light off of the room's ceiling, but also having a small, aesthetically pleasing downward component. More particularly, this invention relates to indirect office environment fluorescent tube lighting fixtures which are mountable close to the ceiling while providing uniform illumination of the ceiling and a high efficiency fixture.

2. Description of Prior Art

With the recent proliferation of Video Display Terminals (VDTs) in the office environment, lighting designers have identified high contrast overhead lighting as a source of glare and reflection on VDT screens. Such glare and reflection is an undesirable effect which impacts worker comfort and productivity. Thus, the need has arisen for efficient low contrast illumination of the work environment.

Indirect fluorescent tube overhead lighting has been determined to be the most efficient means of illuminating a large office environment, while providing low contrast illumination of the work area. Such lighting is accomplished by positioning fluorescent tube fixtures below the plane of the ceiling and directing nearly all of the light upward toward the ceiling. The light is then reflected off of the ceiling downward toward the room. However, low contrast illumination of the work area requires a uniform illumination of the ceiling.

Indirect fluorescent tube overhead lighting fixtures of the current art often must be suspended a significant distance below the plane of the ceiling in order to obtain a uniform light pattern. This phenomena is due to the fact that the optical reflector systems, or the lack thereof, in such fixtures distribute light output toward the ceiling at high angles (angles greater than 105 degrees from nadir) primarily directly above the fixture. Thus, the rows of such fixtures must be located close to one another, increasing the number and cost of the installation, or suspended farther from the ceiling in order to achieve uniform illumination of the ceiling. A problem, however, with mounting the fixtures a significant distance below the ceiling is that a 'false ceiling' impression is created by the rows of fixtures needed to illuminate a large work area. For instance, when looking out across a room containing multiple rows of suspended fixtures, the rows of fixtures themselves form a plane of fixtures at the suspension distance below the plane of the ceiling. In a room with 9 or 10 foot ceilings, a suspension distance of 24 to 36 inches will create an uncomfortably low false ceiling.

Previous efforts to design fixtures with lower angles of light distribution have resulted in less efficient fixtures.

Additionally, designers have found that eliminating glare does not in itself result in a pleasant environment. An appropriate perceived brightness has been found to be necessary to create comfort and a sense of well-being. Thus, lighting designers have recently indicated an preference for aesthetic, low illumination of the fixture housing when viewed from the working area of the room. However, efforts to design fixtures having illuminated housings when viewed from below have also resulted in less efficient fixtures.

BRIEF SUMMARY OF THE INVENTION

It is an object of the present invention to provide an indirect fluorescent tube overhead lighting fixture with an optical system distributing light at low angles while maintaining a high efficiency.

It is a further object of the present invention to provide an indirect fluorescent tube overhead lighting fixture having an illuminated housing when viewed from below while maintaining a high efficiency.

These and other objects are achieved through the use of an optical system having a tubular lamp, a parabolic reflector assembly under the lamp, a pair of kick reflector assemblies on either side of the lamp and spaced from the parabolic reflector assembly creating openings, and a housing having translucent areas in optical communication with the lamp through the openings.

The parabolic reflector assembly may have a pair of substantially parabolic shaped reflectors joined to form an apex in a vertical plane defined by the apex and the longitudinal axis of the tubular lamp. The parabolic shaped reflectors may be symmetric about the vertical plane. The parabolic reflectors may each have a proximate edge along the apex and a distal edge opposite to the proximate edge. Further, the parabolic reflector distal edges and the tubular lamp longitudinal axis may be positioned to define planes intersecting the vertical plane at substantially 60 degrees on either side of the vertical plane.

The substantially parabolic shaped reflectors may also be comprised or approximated by at least two arc segments.

Each kick reflector assembly may be symmetric with the other about the lamp axis vertical plane, and may have a substantially vertical section which lies in a plane which is upwardly and outwardly diverging from the lamp axis vertical plane. Additionally, each kick reflector assembly may further have a horizontal section extending inwardly from the substantially vertical section and having a proximate edge located along the opening between the kick reflector assembly and the parabolic reflector assembly. Further, the kick reflector assembly horizontal section proximate edges and the tubular lamp longitudinal axis may be positioned to define planes intersecting the vertical plane at substantially 73 degrees on either side of the vertical plane.

Additionally, the invention may be embodied in an optical system having two tubular lamps horizontally spaced from and parallel to each other and having a parabolic reflector assembly under each lamp. An intermediate reflector section may bridge any space between the parabolic reflector assemblies. A wall mounted luminaire will utilize a first elongated kick reflector positioned adjacent to one lamp. A suspended luminaire will also have a second elongated kick reflector positioned adjacent to the other lamp. A housing is positioned around the lamps and reflectors. The housing has an open top for allowing light to exit the optical system at low angles toward the ceiling. Further, the housing may have similar translucent areas in optical communication with the lamps through openings that may exist between the parabolic reflector assemblies and the kick reflectors or the housing.

DETAILED DESCRIPTION OF THE INVENTION

1. Suspended Single Lamp Luminaire Optical System

Figure 1:
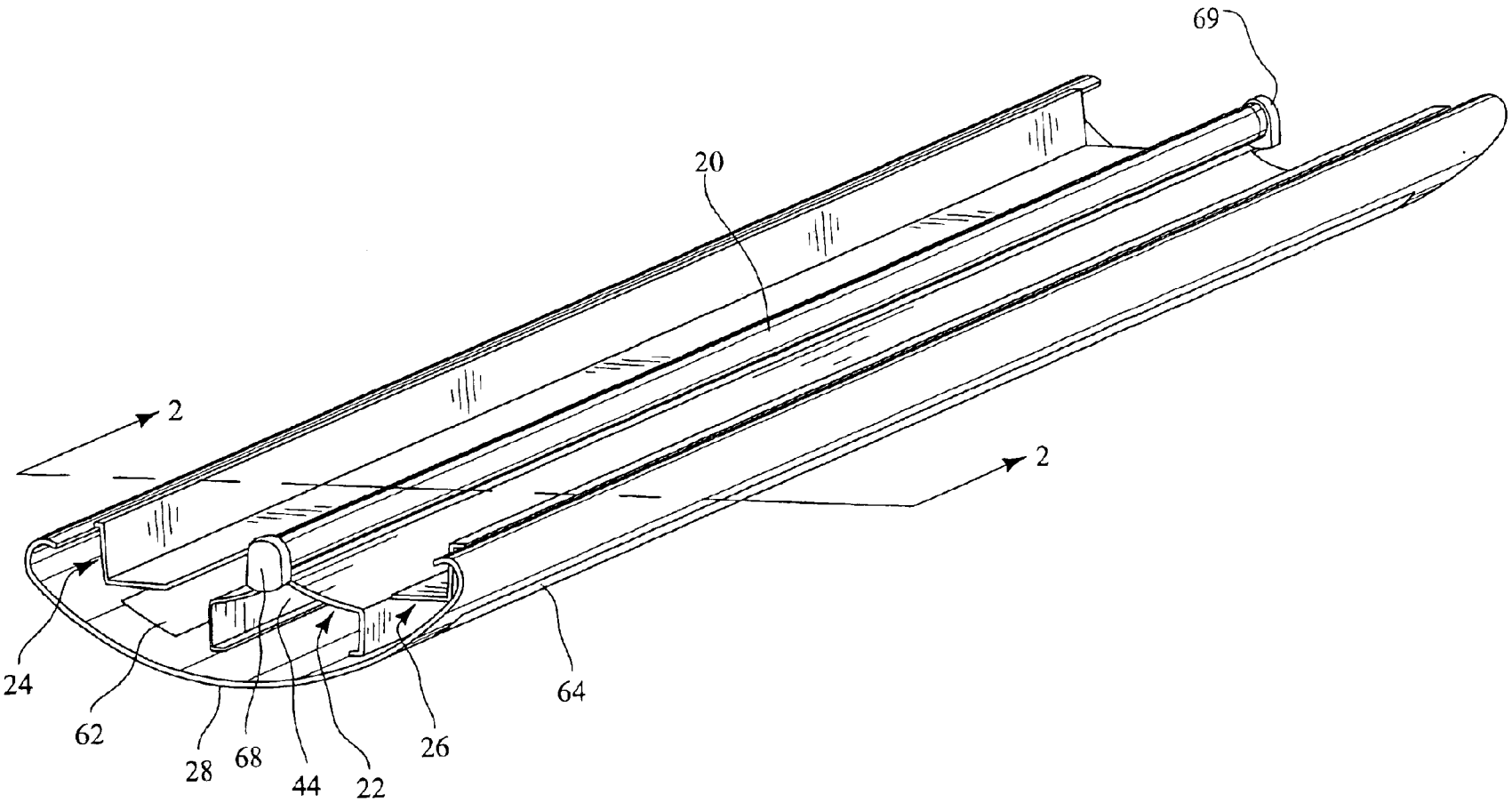
FIG. 1 shows a perspective view of a luminaire optical system of one embodiment of the present invention.
Figure 2:
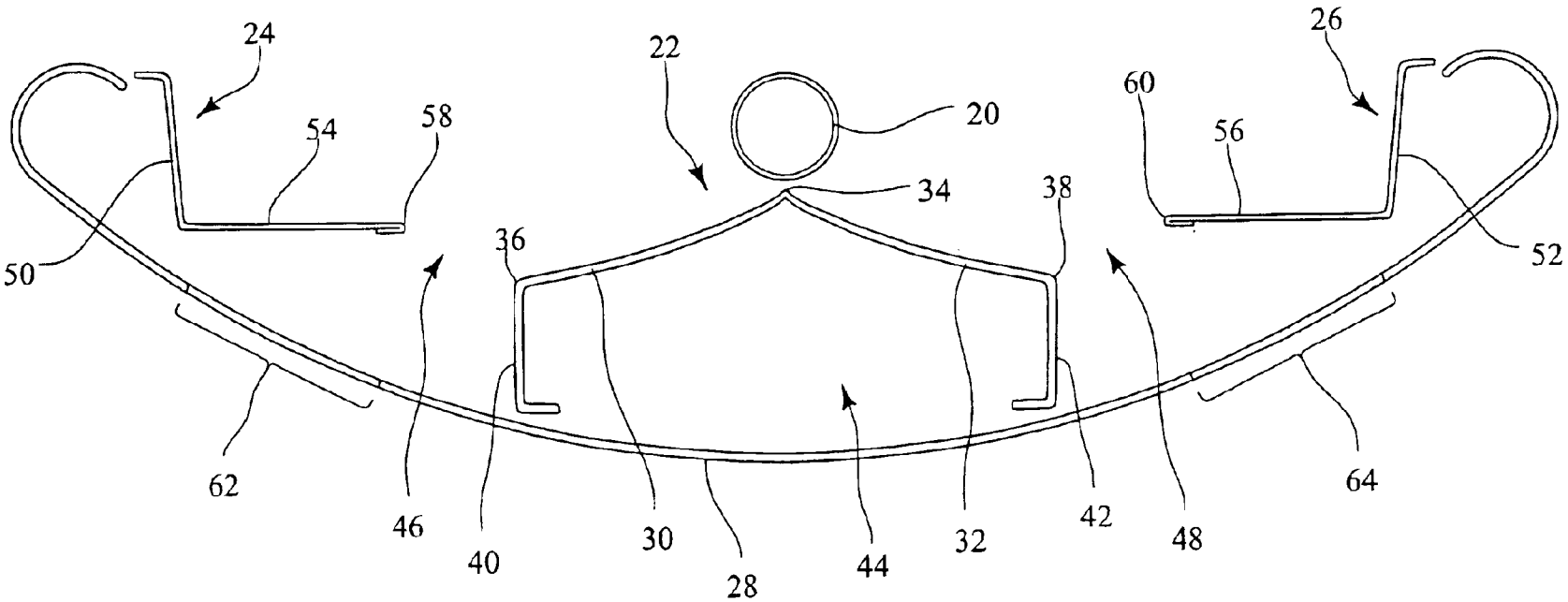
FIG. 2 shows a sectional view of the system taken along the line 2—2 of FIG. 1.

As shown in FIGS. 1 and 2, the luminaire optical system of one embodiment of the invention comprises a single tubular lamp 20, a parabolic reflector assembly 22, a pair of kick reflector assemblies 24, 26 and a housing 28.

The tubular lamp 20 of the single lamp embodiment may be a 54-watt T5 high output type fluorescent lamp, but one skilled in the art will recognize that the benefits of the optical system of the invention will be realized with any tubular lamp.

As shown in FIG. 2, the parabolic reflector assembly 22 has a pair of substantially parabolic shaped reflectors 30, 32 located beneath the lamp 20. The parabolic shaped reflectors 30, 32 are joined to form an apex 34 along and directly under the lamp 20, with the apex 34 lying in a vertical plane which passes through the longitudinal axis of the lamp 20. The parabolic shaped reflectors 30, 32 are symmetric with each other about the lamp axis vertical plane. Thus, a proximate edge of each parabolic reflector 30, 32 is located along the apex 34. Distal edges 36, 38 are located opposite to the proximate edges.

Figure 2A:
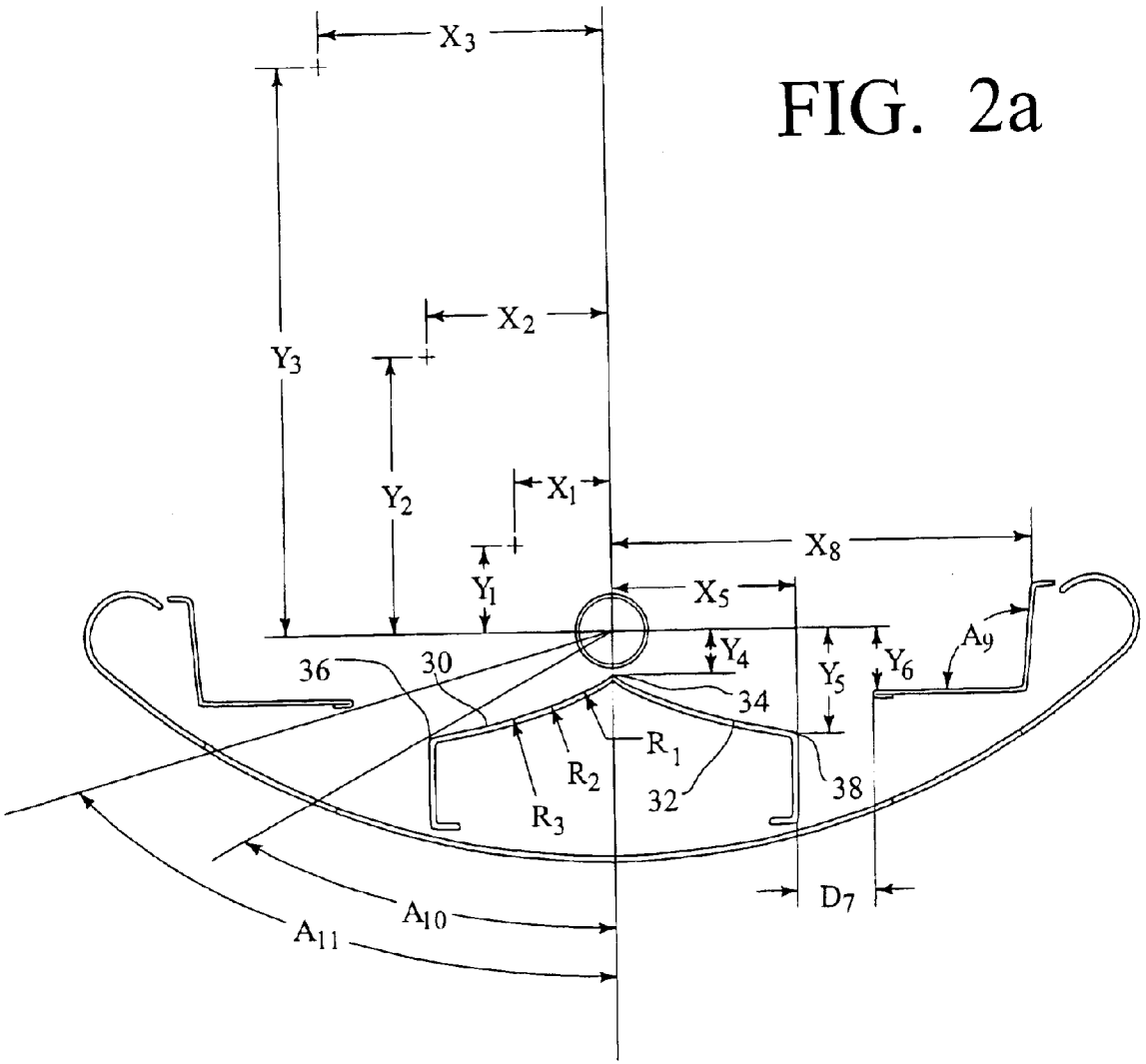
FIG. 2*a* shows the sectional view of FIG. 2 with dimensional references.

Important dimensions of the single lamp embodiment of the luminaire optical system of the present invention are shown in FIG. 2*a*, and may approximate the following values:

| | |
|---|---|
| $X_1$ | 0.837" |
| $Y_1$ | 0.778" |
| $R_1$ | 1.411" |
| $X_2$ | 1.577" |
| $Y_2$ | 2.369" |
| $R_2$ | 3.165" |
| $X_3$ | 2.455" |
| $Y_3$ | 4.980" |
| $R_3$ | 5.924" |
| $Y_4$ | 0.370" |
| $X_5$ | 1.577" |
| $Y_5$ | 0.877" |
| $Y_6$ | 0.648" |
| $D_7$ | 0.587" |
| $X_8$ | 3.595" |
| $A_9$ | 95° |
| $A_{10}$ | 60° |
| $A_{11}$ | 73° |

As shown in FIG. 2*a*, the apex 32 is located 0.370" beneath the longitudinal axis of the lamp 20. Since the lamp of the embodiment shown in FIG. 2*a* is a T5 type lamp, having a diameter of about 5/8" (0.625"), or a radius of about 5/16" (0.3125"), the apex 32 is located only approximately 0.0575" beneath the bottom of the lamp 20.

As further shown FIG. 2*a*, the parabolic shaped reflector distal edges 36, 38 and the longitudinal axis of the tubular lamp 20 define planes intersecting the lamp axis vertical plane at substantially 60 degrees $A_{10}$ on either side of the vertical plane.

For ease of manufacturing, the substantially parabolic shaped reflectors 30, 32 of the instant invention may be approximated by combining two or more arc segments together. For instance, as shown in FIG. 2, the substantially parabolic shaped reflectors 30, 32 are approximated by three arc segments of increasing radii, $R_1$, $R_2$, and $R_3$, having arc centers of $X_1$, $Y_1$; $X_2$, $Y_2$; and $X_3$, $Y_3$, respectively.

Figure 3:
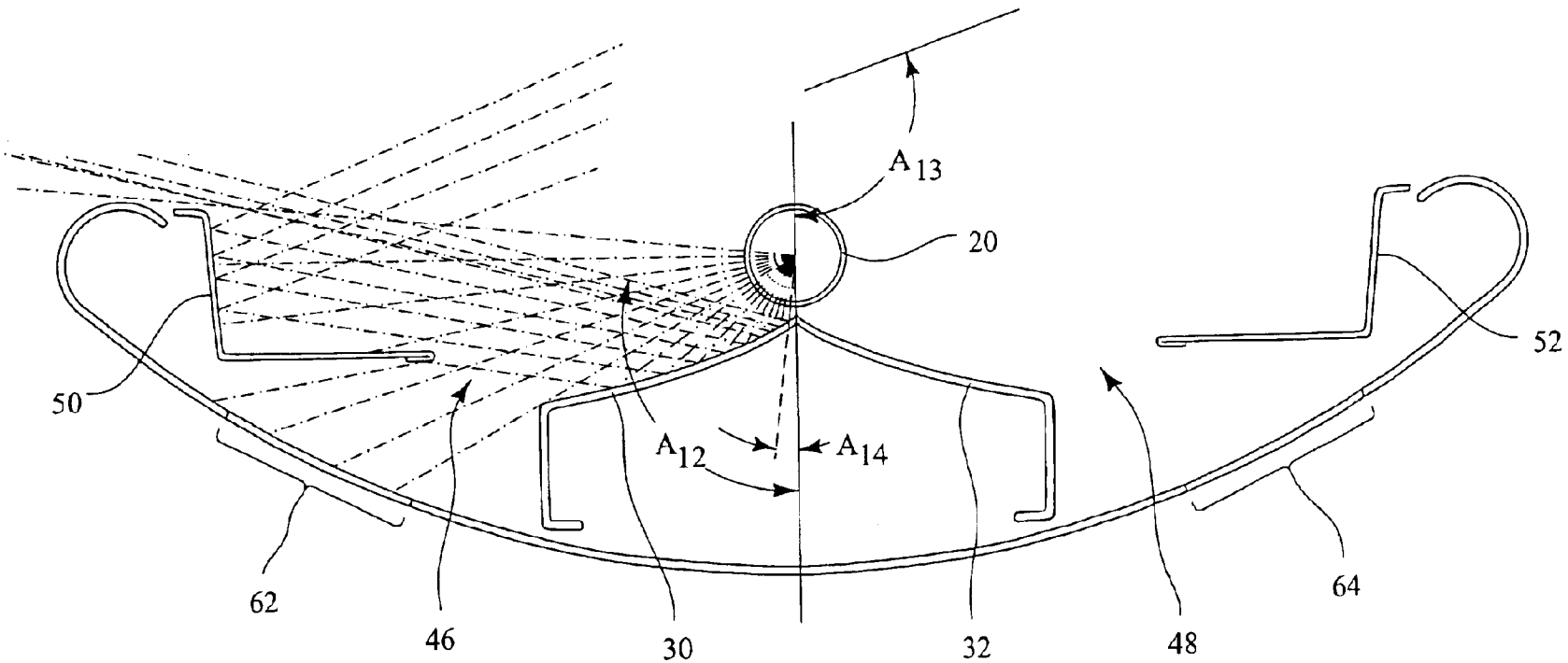
FIG. 3 shows the sectional view of FIG. 2 with a ray trace diagram of light emanating from a lower quadrant of a tubular lamp superimposed thereon.

Specifically, as shown in FIG. 3, the arrangement of the parabolic reflectors 30, 32 redirects light from the underside of the lamp upward and outward from the fixture at low angles. Thus, light emitted from the bottom half of the lamp is collected by the parabolic shaped reflectors 30, 32 and focused out of the fixture at relatively low angles toward the ceiling. For example, as shown in FIG. 3, a light ray exiting the lamp at an angle represented by $A_{14}$, which is about 7°, is reflected off of the top portion of the parabolic shaped reflector 30 and exits the fixture at an angle represented by $A_{12}$, which is about 105°. This results in efficient and effective use of light that would otherwise have been reflected back into the lamp or out of the fixture at undesirable angles.

It is important to note that, while FIG. 3 shows light emanating from the axis of the lamp, in actuality the light from a fluorescent lamp radiates from the surface of the tube. However, the representation shown in FIG. 3 is an adequate approximation for the purpose of this description.

Returning to FIG. 2, the parabolic reflector assembly of the single lamp embodiment of the invention also has vertical sections 40, 42 depending from the parabolic reflectors 30, 32 (respectively) which, together with the housing 28 define a channel 44 which runs the length of the fixture in which the ballast, wiring and other electrical components (not shown) for the fixture may be located.

Also shown in FIG. 2, the kick reflector assemblies 24, 26 are each in a spaced relationship with the parabolic reflector assembly 22, thereby defining openings 46, 48 between the parabolic reflector assembly 22 and the kick reflector assemblies 24, 26. Housing 28 has translucent areas 62, 64 which are in optical communication with the lamp 20 through the openings 46, 48.

Preferably, the kick reflector assemblies 24, 26 are symmetric with each other about the above-described vertical plane through the axis of the tubular lamp 20 and have substantially vertical sections 50, 52 which lie in planes which are upwardly and outwardly diverging from the lamp axis vertical plane.

Also, as shown in FIG. 2, the kick reflector assemblies 24, 26 of the single lamp embodiment of the invention each further have a horizontal section 54, 56 extending inwardly from the base of the substantially vertical sections 50, 52. The horizontal sections 54, 56 each have a proximate edge 58, 60 along the openings 46, 48.

As shown in FIG. 3, this orientation allows the substantially vertical sections 50, 52 to catch the light directed outward from each side of the lamp 20, along with light reflected off of the horizontal sections 54, 56 and a portion of the light directed from the parabolic shaped reflectors 30, 32, and redirect it around the lamp 20 and out of the fixture at relatively low angles. For example, the angle $A_{13}$ may be about 109°.

As shown in FIG. 2*a*, the horizontal section proximate edges 58, 60 of the single lamp embodiment of the invention and the longitudinal axis of the tubular lamp define planes which intersect the lamp axis vertical plane at substantially 73 degrees $A_{11}$ on either side of the vertical plane.

Thus, as shown in FIG. 3, the openings 46, 48 allow illumination from the underside of the lamp substantially in the range from 60 degrees to 73 degrees on either side of the lamp to reach the housing translucent areas 62, 64. This small amount of light is allowed to "bleed" through to illuminate the translucent areas 62, 64 of the housing 28 rather that be reflected upward toward the ceiling. Thus, the arrangement of the reflectors of this fixture allows for an aesthetically pleasing illumination of the housing 28 while still maintaining a very high overall fixture efficiency.

Figure 5:
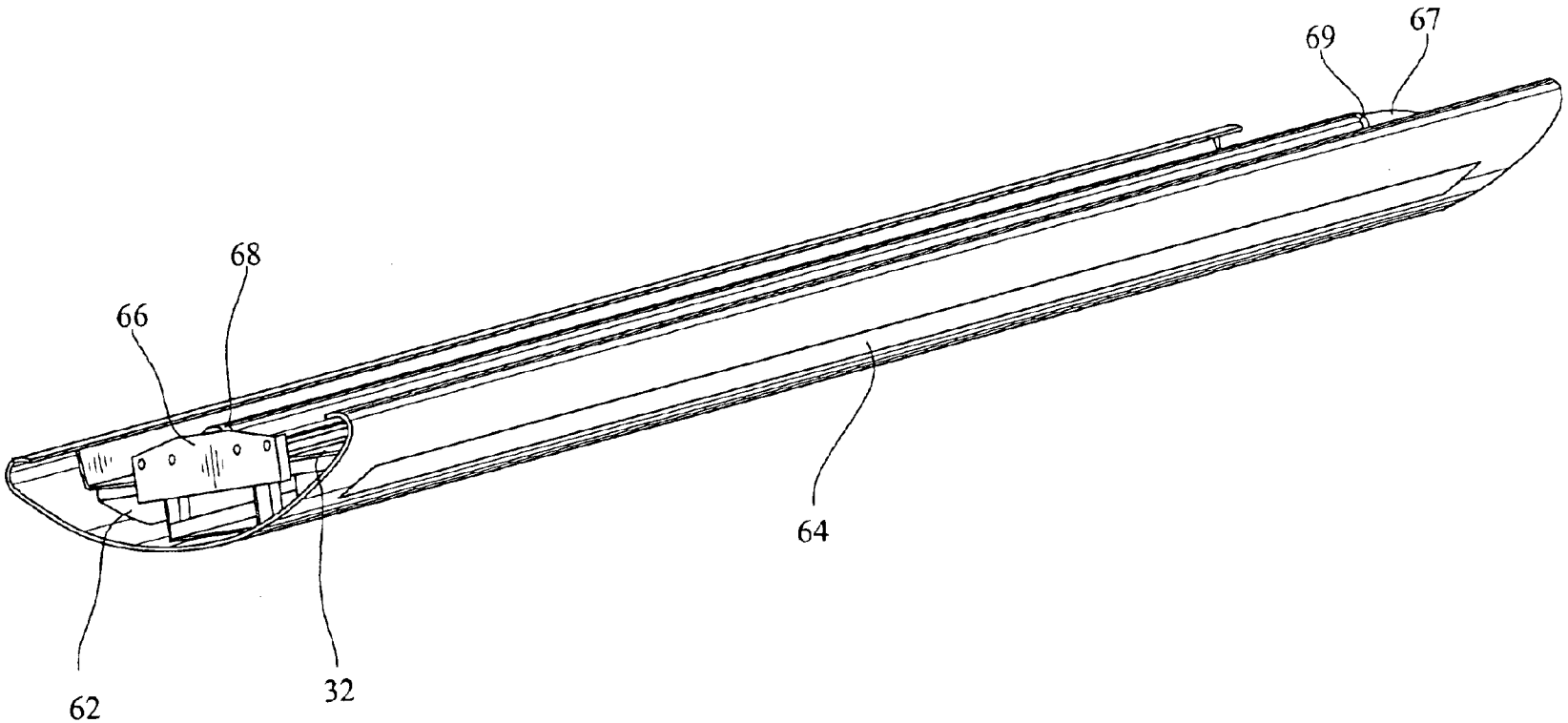
FIG. 5 shows a perspective view of the luminaire optical system of FIG. 1 with the components attached together by a bracket assembly.
Figure 7:
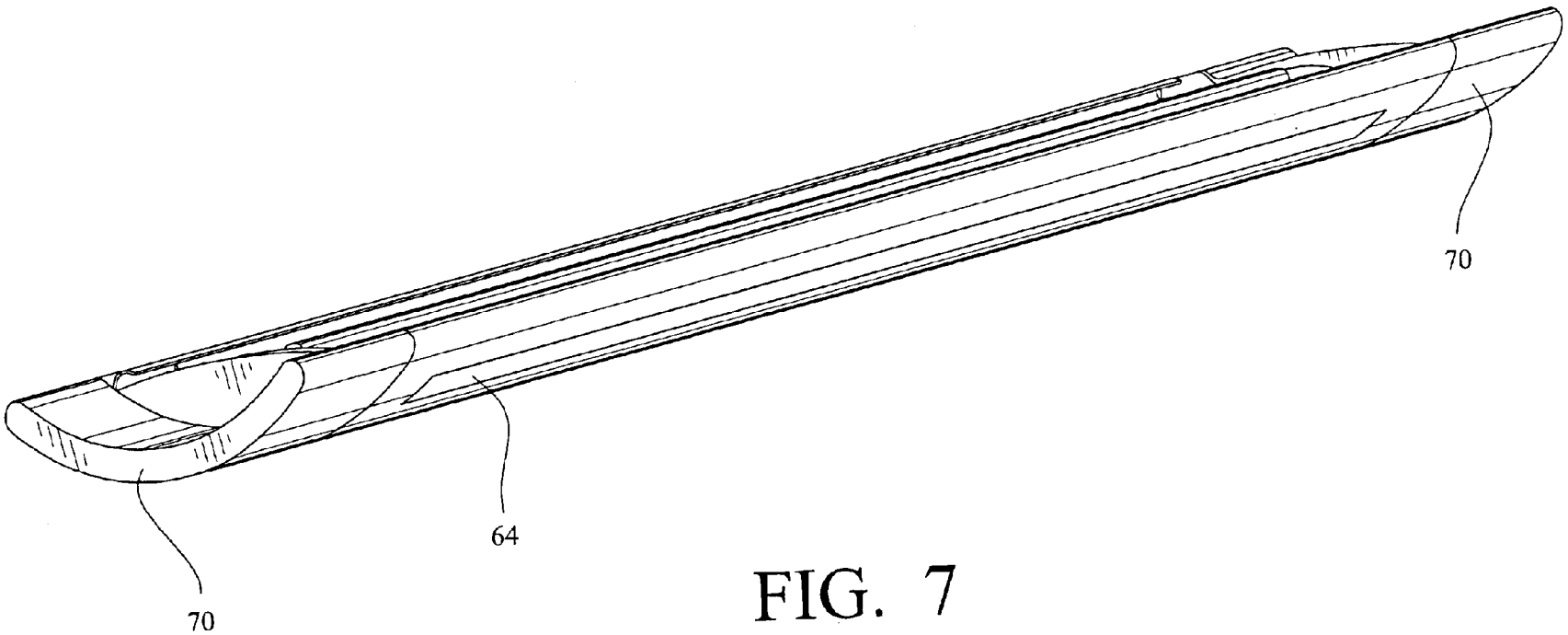
FIG. 7 shows a fully assembled light fixture, including end caps, containing the luminaire optical system of FIG. 1.
Figure 8:
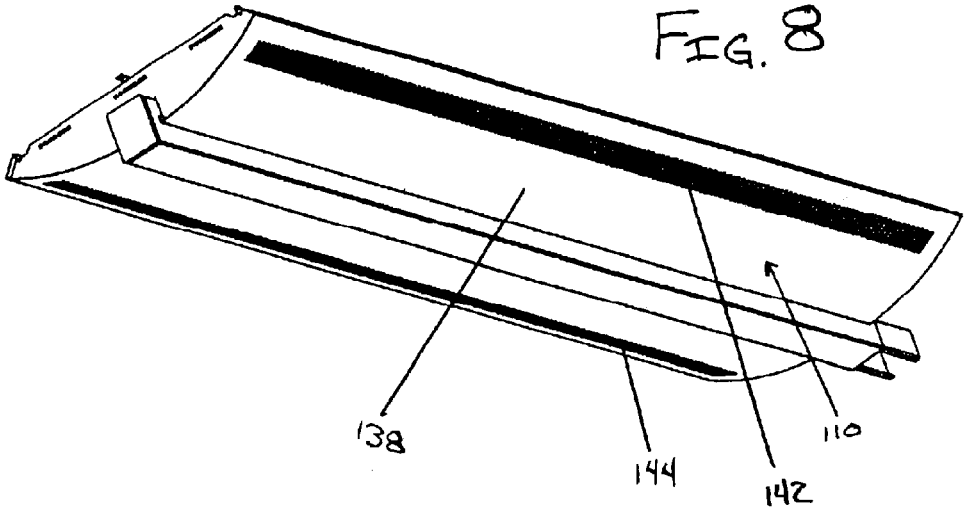
FIG. 8 shows a perspective view of another embodiment of a luminaire utilizing an optical system of the present invention.

The translucent areas 62, 64 are formed by an acrylic translucent diffuser material in conjunction with perforating or piercing the housing material, which is preferably an 18 gauge steel. One of the translucent areas 64 is shown in FIGS. 5 and 7, also.

Further, in the single lamp embodiment as shown in FIG. 2, the kick reflector assembly horizontal sections 54, 56 are positioned slightly higher than the elevation of the parabolic shaped reflector distal edges 36, 38. Thus, as shown in FIG. 3, a small portion of the light reflecting off of the parabolic shaped reflectors 30, 32 will strike the underside of the kick reflector assembly horizontal sections 54, 56 and be reflected downward toward the housing translucent areas 62, 64.

All surfaces of the parabolic reflector assembly 22 and the kick reflector assemblies 24, 26 having direct exposure to the tubular lamp 20 are finished to be to some degree reflective to light. Preferably, these surfaces have a semi-specular finish. Additionally, the underside of kick reflector assembly horizontal sections 54, 56 as well as the parabolic reflector assembly vertical sections 40, 42 have a semi-specular finish to further aid in the reflection of light to the housing translucent areas 62, 64.

Additionally, the parabolic reflector assembly 22 and the kick reflector assemblies 24, 26 are each manufactured in a unitary construction, with each assembly being formed from a single piece of material to achieve manufacturing and assembly efficiencies. However, this manufacturing and assembly technique should not be construed to limit in any way the scope of the invention disclosed and claimed herein.

Figure 6:
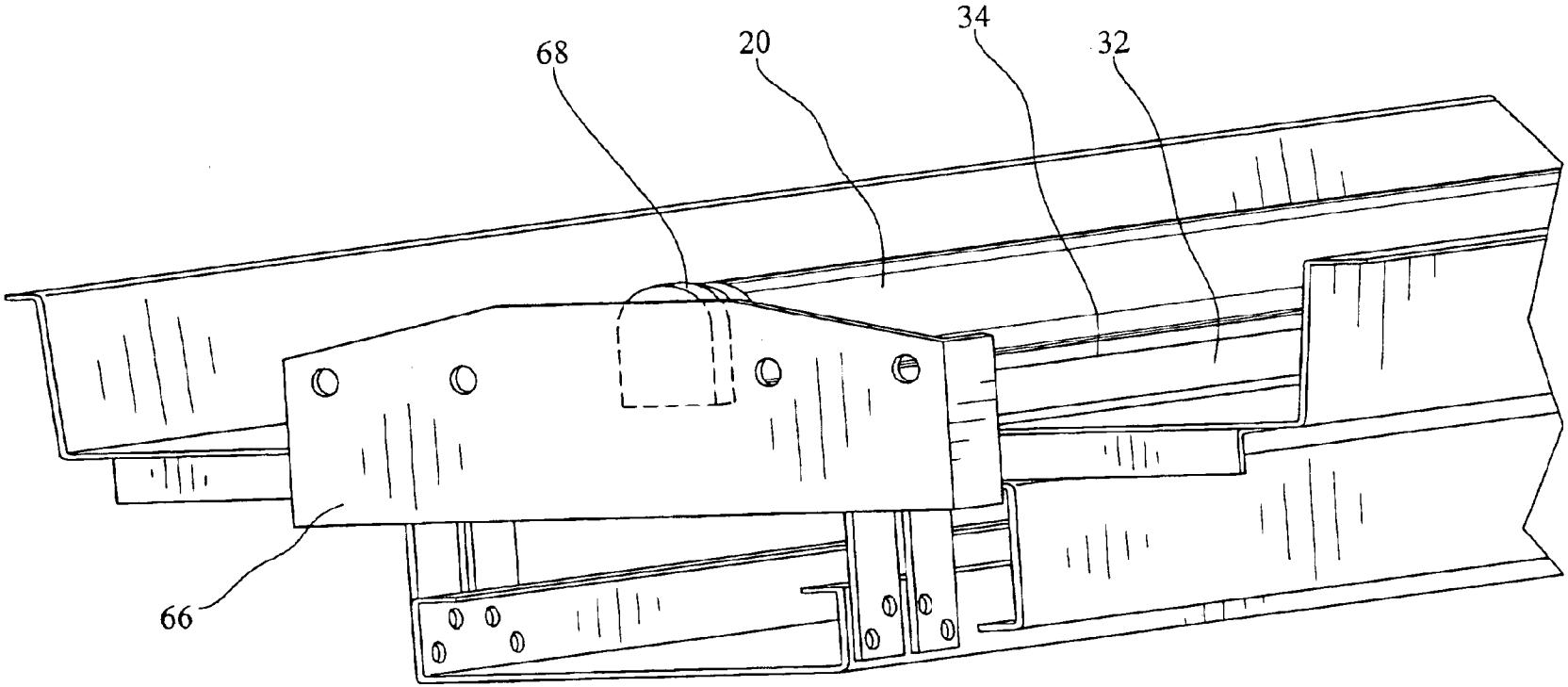
FIG. 6 shows a partial perspective view of the bracket assembly of FIG. 5.

Bracket assemblies 66, 67, shown in FIG. 5, connect the components of the optical system to form a light fixture. Thus, the bracket assemblies 66, 67 hold lamp sockets 68, 69 in position at each end of the fixture. As best shown in FIG. 6, the lamp sockets 68, 69 in turn, support the tubular lamp 20 in position just over the apex 34 of opposing parabolic reflectors 30, 32.

A fully assembled fixture may also have decorative end caps 70, shown in FIG. 7, or may be joined with other fixtures to form uninterrupted runs of fixtures (not shown).

Figure 4:
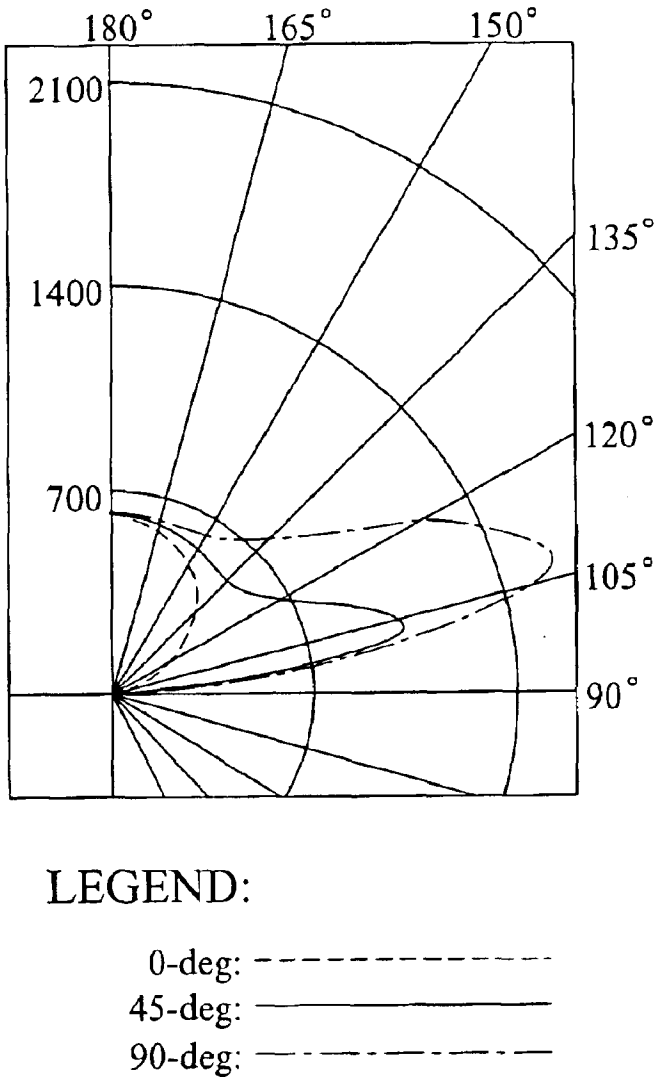
FIG. 4 is a candela distribution plot of the results of a test of the luminaire optical system of FIG. 1.

The results of photometric testing performed on the single lamp embodiment described herein using a 54-watt T5 FP54W/835/HO high output linear fluorescent lamp rated at 5000 lumens output are depicted in the polar plot shown in FIG. 4. Said testing indicated peak output of 1605 candela at 107.5 degrees while demonstrating an overall fixture efficiency of 86.9%. Further testing of the single lamp embodiment described herein with fixtures mounted 12 inches below the ceiling and spaced 12 foot on centers produced an approximately 6:1 luminance ratio at the surface of the ceiling. Additional testing of the closest known competitor indicated a 9:1 luminance ratio under the same conditions.

The arrangement of parabolic reflectors 30, 32 and kick reflectors 50, 52 in conjunction with the housing 28, housing translucent portions 62, 64, and a tubular lamp 20, creates a very efficient fixture having high candela output at very low angles. Thus, the fixture may be mounted close to the ceiling of a room while still providing an efficient uniform illumination of the ceiling.

2. Suspended Two Lamp Indirect Luminaire Optical System

As shown in FIGS. 8 through 11, the indirect luminaire optical system of another embodiment of the invention comprises a first tubular lamp 100, a second tubular lamp 102, a first elongated parabolic reflector 104, a second elongated parabolic reflector 106, a first elongated kick reflector 108, a second elongated kick reflector 109, and a housing 110.

Figure 9:
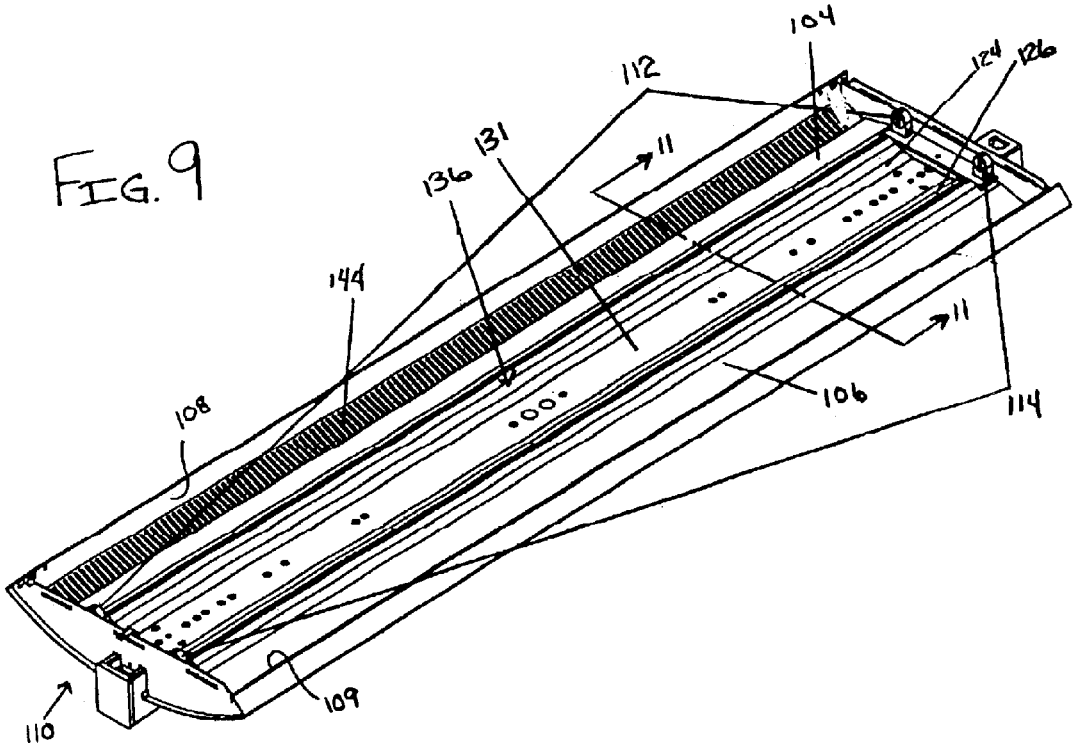
FIG. 9 shows a different perspective view of the luminaire of FIG. 8.
Figure 10:
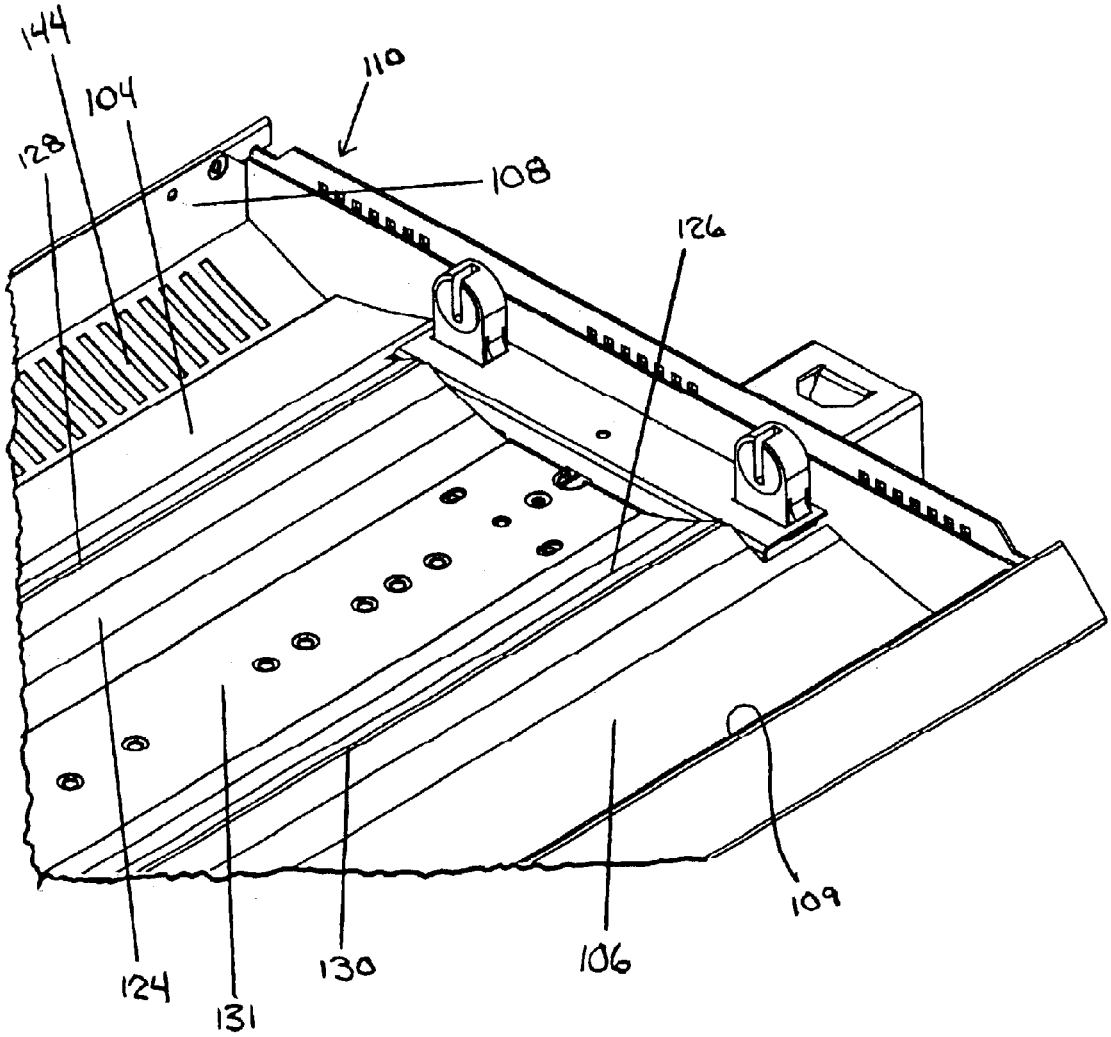
FIG. 10 shows an enlarged view of a portion of the luminaire of FIG. 9.

Indirect luminaires employing the optical system described herein may be manufactured and distributed with or without the tubular lamps being pre-installed. However, the location of the tubular lamps in the optical system of the luminaire is determined by the location of the lamp sockets for the lamps. Thus, as shown in FIG. 9, an indirect luminaire of the present embodiment will have a first pair of opposing lamp sockets 112 for the first tubular lamp 100, and a second pair of opposing lamp sockets 114 for the second tubular lamp 102. For convenience, a first longitudinal axis 116 is described as being defined by the first pair of sockets 112, and a second longitudinal axis 118 is described as being defined by the second pair of sockets 114. Thus, the first longitudinal axis 116 lies substantially at the center of the first lamp 100 and the second longitudinal axis 118 lies substantially at the center of the second lamp 102.

Similar to the previous embodiment, the tubular lamps may be T5 type fluorescent lamps. However, the benefits of the optical system of the invention will be realized with any linear type tubular lamps.

Figure 11:
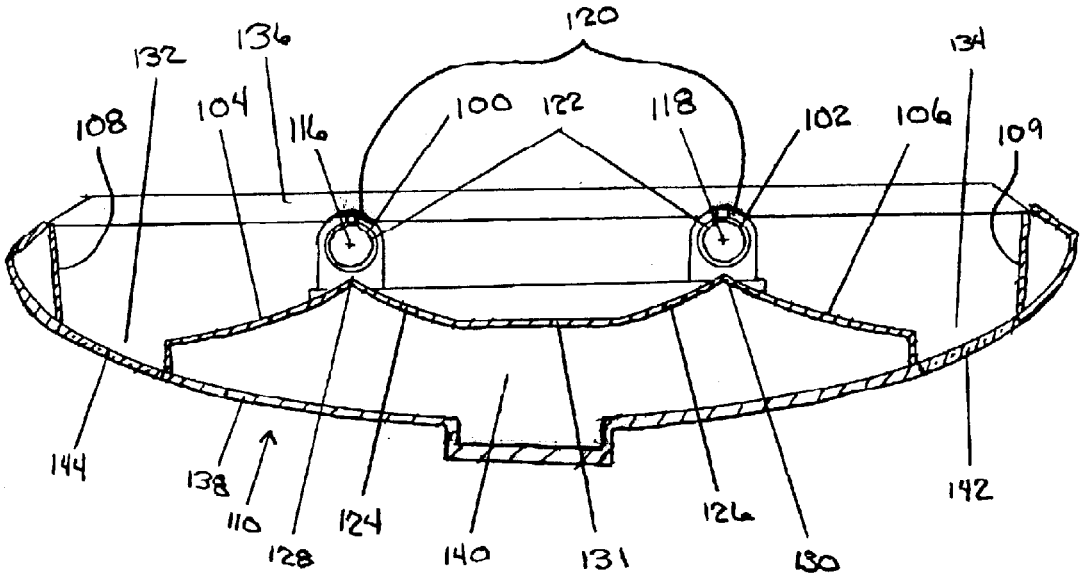
FIG. 11 shows a sectional view. taken along the line 11—11 of FIG. 9, with the addition of lamps.

As shown in FIG. 11, the lamp sockets 112, 114 are positioned such that the lamps 100, 102 are horizontally spaced from and parallel to each other. Thus, the lamp sockets 112, 114 can be described collectively as a lamp socket assembly 120. Further, the lamps 100, 102 can be described collectively as a lamp assembly 122.

The first elongated parabolic reflector 104 extends below the first lamp 100, while the second elongated parabolic reflector 106 extends below the second lamp 102, as shown. Each of the parabolic reflectors 104, 106 has a substantially parabolic shaped cross section that collects light from the underside of the respective lamp 100, 102 and focuses it as desired by the luminaire designer.

As described for the previous embodiment, the present embodiment also has a third elongated parabolic reflector 124 and a fourth elongated parabolic reflector 126. The third parabolic reflector 124 and the fourth parabolic reflector 126 also have substantially parabolic shaped cross sections. Thus, as shown in FIG. 11, the first parabolic reflector 104 and the third parabolic reflector 124 may be joined along their top edges to form a first elongated apex 128. Likewise, the second parabolic reflector 106 and the fourth parabolic reflector 126 may be joined along their top edges to form a second elongated apex 130. Preferably, the parabolic reflectors 104, 106, 124, 126 are then positioned such that the first apex 128 is parallel to and directly under the first lamp 100 (or the first longitudinal axis 116) and the second apex 130 is parallel to and directly under the second lamp 102 (or the second longitudinal axis 118).

The parabolic forms of the present two lamp embodiment are substantially the same as the form of the one lamp embodiment described earlier, as both embodiments as shown are designed for use with T5 type fluorescent lamps. Again, for ease of manufacturing, the parabolic reflectors 104, 106, 124, 126 may have their substantially parabolic shape approximated by combining two or more arc segments together.

Also, as further shown in FIG. 11, the present embodiment may have an intermediate reflector section 131 positioned between the third parabolic reflector 124 and the fourth parabolic reflector 126. The intermediate reflector section 131 has a flat, substantially horizontal reflective surface and bridges any space that may exist between the parabolic reflector pairs 104/124, 106/126 to reflect light directed to that area out of the luminaire, thereby preventing that light from being trapped in the fixture. Thus, the intermediate reflector section 131 serves to increase the efficiency of the luminaire.

Also similar to the previous embodiment, the present embodiment utilizes a first elongated kick reflector 108 and a second elongated kick reflector 109. The first kick reflector 108 is positioned to extend adjacent to the side of the lamp assembly 122 along the first lamp 100, while the second kick reflector 108 is positioned to extend adjacent to the side of the lamp assembly 122 along the second lamp 102, as shown.

The kick reflectors 108, 109 of the present embodiment are substantially flat and vertical, or are slightly diverging in an upward direction in order to further direct light from the lamps 100, 102, both illumination directly emitted from the lamps and illumination reflected off of the parabolic reflectors 104, 106, 124, 126, outward from the luminaire at low angles.

Preferably, as shown, the first kick reflector 108 and the first parabolic reflector 104 are in a spaced relationship whereby a first opening 132 is formed therebetween, and the second kick reflector 109 and the second parabolic reflector 106 are also in a spaced relationship whereby a second opening 134 is formed therebetween. This arrangement allows a portion of the light emitted from each lamp to reach the housing 110.

The housing 110 is a part of the indirect luminaire optical system in that has a top portion 136 and a bottom portion 138. The top portion 136 is substantially open to allow direct and reflected light from the lamps 100, 102 to exit from the luminaire. The bottom portion 138 is substantially closed and is located under the parabolic reflectors 104, 106, 124, 126 and the kick reflectors 108, 109. A wiring channel 140 may be formed between the housing bottom portion 138 and the parabolic reflectors 104, 106, 124, 126 and the intermediate reflector section 131. Additionally, the housing bottom portion 138 may serve as a base for attaching all of the component elements of the indirect luminaire optical system, and be finished provide an attractive appearance to the luminaire when viewed from below.

Still further, the housing bottom portion 138 may have a first elongated translucent area 142 located to be in optical communication with the second lamp 102 through the second opening 134, and a second elongated translucent area 144 located to be in optical communication with the first lamp 100 through the first opening 132. Thus, as in the previous single lamp embodiment, the translucent areas 142, 144 of the present embodiment may have a small, aesthetically pleasing illumination when viewed from below.

The preferred materials and finishes as described for the single lamp embodiment are also applicable to the current two lamp embodiment. Thus, the translucent areas 142, 144 may be formed by an acrylic translucent diffuser material in conjunction with perforating or piercing the housing material. Further, all reflective surfaces described may be finished to a semi-specular finish.

Figure 12:
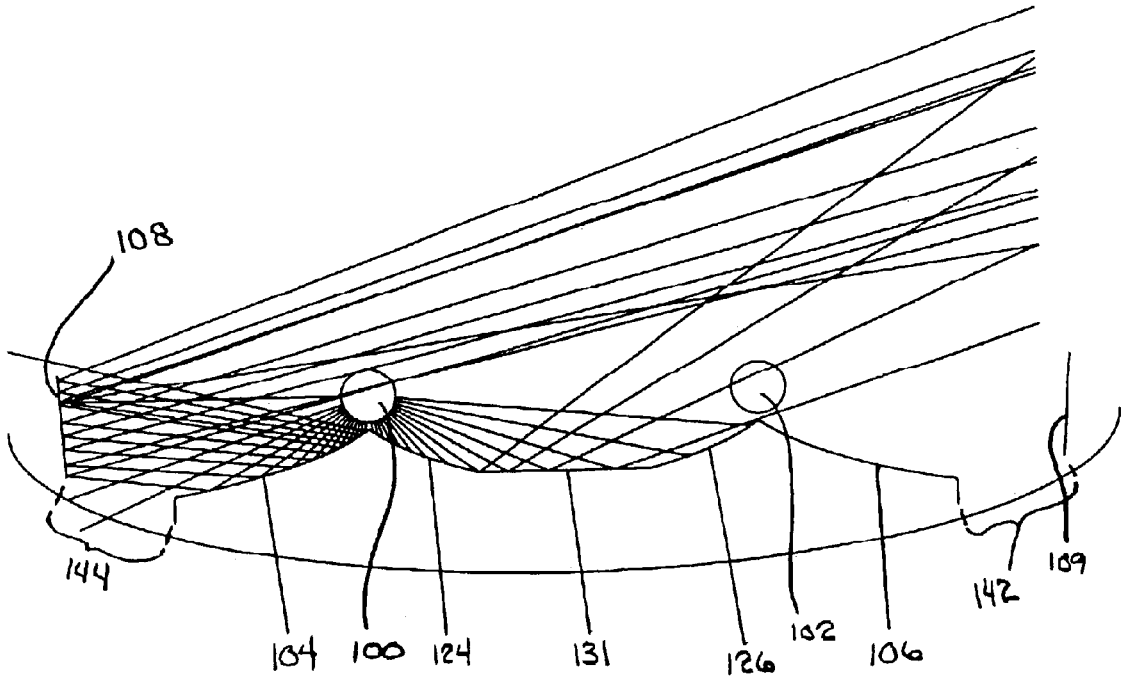
FIG. 12 shows a ray trace diagram of the optical system of the luminaire of FIG. 8.

Thus, as partially shown in FIG. 12, the parabolic reflectors 104, 106, 124, 126 in cooperation with the kick reflectors 108, 109 and the intermediate reflector section 131 redirect illumination emanating from the underside of the lamps 100, 102 out of the fixture at low angles. The spacing between the lamps minimizes the interference between light reflected the interior (third and fourth) parabolic reflectors 124, 126 and the adjacent lamps such that nearly all illumination from the lamps is directed out of the luminaire in the desired low angle directions. Thus, the two lamp embodiment is capable of achieving a light distribution pattern very similar to the pattern of the one lamp embodiment, with substantially twice the light output. Therefore, similar light levels and uniformity are achievable with approximately one half of the number of fixtures.

3. Wall Mounted Luminaire Optical System

Figure 13:
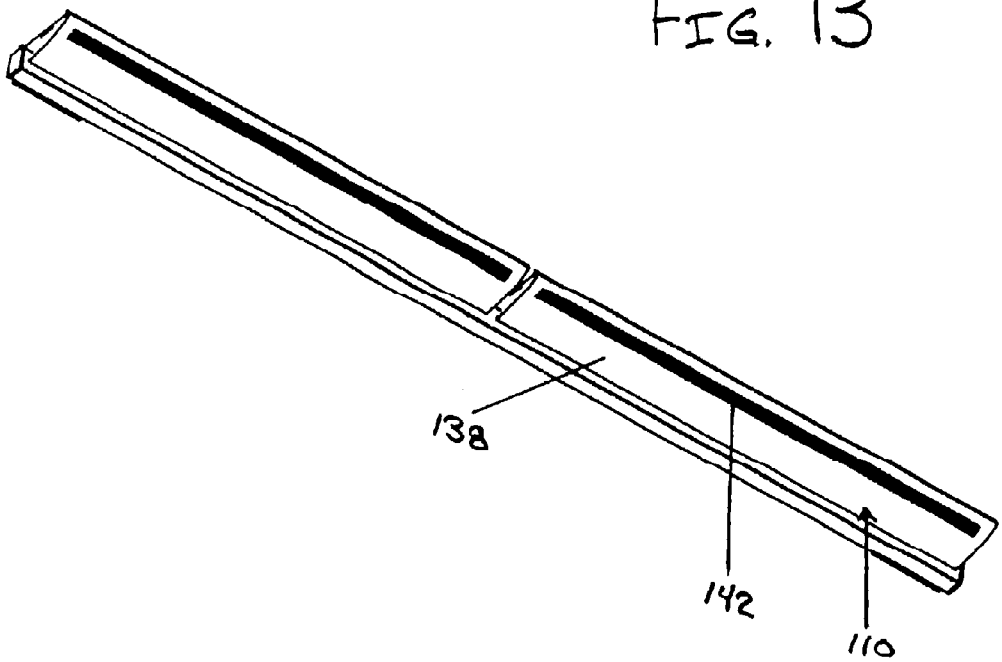
FIG. 13 shows a perspective view of yet another embodiment of a luminaire utilizing the optical system of the present invention.
Figure 14:
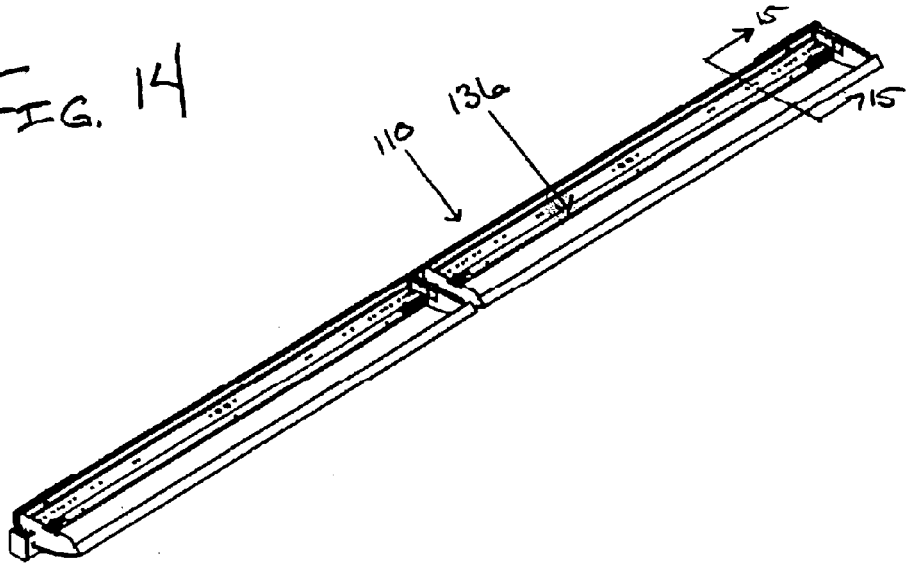
FIG. 14 shows another perspective view of the luminaire of FIG. 13.
Figure 15:
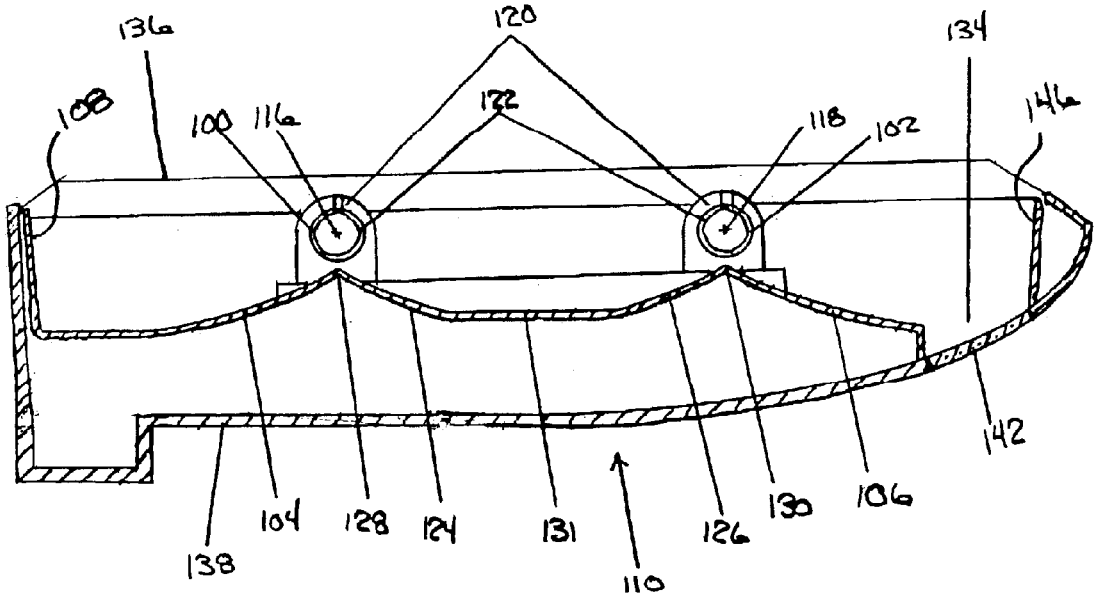
FIG. 15 shows a sectional view taken along the line 15—15 of FIG. 14, with the addition of the components of the optical system.

As shown in FIGS. 13 through 15, a wall mounted two lamp embodiment of the invention is represented by minor modifications to the previously discussed suspended two lamp embodiment. The wall mount embodiment also utilizes a first tubular lamp 100, a second tubular lamp 102, a first elongated parabolic reflector 104, a second elongated parabolic reflector 106, and a housing 110. However, the wall mount embodiment utilizes only a first elongated kick reflector 108.

The wall mount embodiment also utilizes first and second pairs of opposing lamp sockets 112, 114 defining first and second longitudinal axes 116, 118, respectively. The sockets are positioned such that the lamps 100, 102 are horizontally spaced from and parallel to one another.

The parabolic reflectors 104, 106, 124, 126 are configured as previously described, forming a first elongated apex 128 and a second elongated apex 130 located directly under and parallel to the first lamp 100 and the second lamp 102, respectively.

An intermediate reflector section 131 may also be present, positioned between the parabolic reflector pairs 104/124, 106, 126.

The first, and only, kick reflector 108 is positioned to extend adjacent to the side of the lamp assembly 122 along the first lamp 100.

As shown in FIG. 15, a blocking element 146, such as a flat, substantially vertical member finished with a light absorbing surface, may be utilized in place of the second kick reflector in order to block the reflection or transmission of illumination in undesired directions.

The housing 110 has a substantially open top portion 136 and a substantially closed bottom portion 138. The bottom portion 138 has only a first translucent area 142, which is located to be in optical communication with the second lamp 102.

Thus, the parabolic reflectors 104, 106, 124, 126 in cooperation with the kick reflector 108 and the intermediate reflector section 131 redirect illumination emanating from the underside of the lamps 100, 102 out of the fixture in the desired direction at low angles.

The detail description of the embodiments contained hereinabove shall not be construed as a limitation of the following claims, as it will be readily apparent to those skilled in the art that design choices may be made changing the configuration of the optical system without departing from the spirit or scope of the claimed invention.

What is claimed is:

1. An optical system for an indirect luminaire, said optical system comprising:

a lamp assembly having:

a first tubular lamp;

a second tubular lamp positioned to be horizontally spaced from and parallel to said first tubular lamp;

a first elongated parabolic reflector extending below said first lamp, said first parabolic reflector having a substantially parabolic shaped cross section;

a second elongated parabolic reflector extending below said second lamp, said second parabolic reflector having a substantially parabolic shaped cross section;

a first elongated kick reflector extending adjacent to a side of said lamp assembly along said first lamp, wherein said first kick reflector and said first parabolic reflector are in a spaced relationship whereby a first opening is formed therebetween;

a second elongated kick reflector extending adjacent to a side of lamp assembly along said second lamp, wherein said second kick reflector and said second parabolic reflector are in a spaced relationship whereby a second opening is formed therebetween; and a housing having a bottom portion and a top portion, wherein said bottom portion further has a first elongated translucent area and a second elongated translucent area, wherein said first translucent area is located to be in optical communication with said second lamp through said second opening, wherein said second translucent area is located to be in optical communication with said first lamp through said first opening, and wherein said housing top portion is open for allowing light to exit said luminaire.

2. The optical system of claim 1 further comprising a third elongated parabolic reflector having a substantially parabolic shaped cross section and a top edge, wherein said first parabolic reflector further has a top edge, wherein said first parabolic reflector top edge is joined to said third parabolic reflector top edge to form a first elongated apex, and wherein said first parabolic reflector and said third parabolic reflector are positioned such that said first apex is parallel to and directly under said first lamp.

3. The optical system of claim 2 further comprising a fourth elongated parabolic reflector having a substantially parabolic shaped cross section and a top edge, wherein said second parabolic reflector further has a top edge, wherein said second parabolic reflector top edge is joined to said fourth parabolic reflector top edge to form a second elongated apex, and wherein said second parabolic reflector and said fourth parabolic reflector are positioned such that said second apex is parallel to and directly under said second lamp.

4. The optical system of claim 3 further having an intermediate reflector section having a flat, substantially horizontal reflective surface, said intermediate section positioned between said third parabolic reflector and said fourth parabolic reflector.

5. An optical system for an indirect luminaire, said optical system comprising:

a lamp assembly having:

a first tubular lamp;

a second tubular lamp positioned to be horizontally spaced from and parallel to said first tubular lamp;

a first elongated parabolic reflector extending below said first lamp, said first parabolic reflector having a substantially parabolic shaped cross section;

a second elongated parabolic reflector extending below said second lamp, said second parabolic reflector having a substantially parabolic shaped cross section;

a first elongated kick reflector extending adjacent to a side of said lamp assembly along said first lamp; and a housing having a bottom portion and a top portion, wherein said bottom portion further has a first elongated translucent area, wherein said first translucent area is located to be in optical communication with said second lamp, and wherein said housing top portion is open for allowing light to exit said luminaire.

6. The optical system of claim 5 further comprising a third elongated parabolic reflector having a substantially parabolic shaped cross section and a top edge, wherein said first parabolic reflector further has a top edge, wherein said first parabolic reflector top edge is joined to said third parabolic reflector top edge to form a first elongated apex, and wherein said first parabolic reflector and said third parabolic reflector are positioned such that said first apex is parallel to and directly under said first lamp.

7. The optical system of claim 6 further comprising a fourth elongated parabolic reflector having a substantially parabolic shaped cross section and a top edge, wherein said second parabolic reflector further has a top edge, wherein said second parabolic reflector top edge is joined to said fourth parabolic reflector top edge to form a second elongated apex, and wherein said second parabolic reflector and said fourth parabolic reflector are positioned such that said second apex is parallel to and directly under said second lamp.

8. The optical system of claim 7 further having an intermediate reflector section having a flat, substantially horizontal reflective surface, said intermediate section positioned between said third parabolic reflector and said fourth parabolic reflector.

9. An indirect luminaire comprising:

a lamp socket assembly having:

a first pair of opposing lamp sockets for a first tubular lamp, said first pair of sockets defining a first longitudinal axis therebetween;

a second pair of opposing lamp sockets for a second tubular lamp, said second pair of sockets defining a second longitudinal axis therebetween, said second pair of sockets positioned such that said second longitudinal axis is horizontally spaced from and parallel to said first longitudinal axis;

a first elongated parabolic reflector extending below said first longitudinal axis, said first parabolic reflector having a substantially parabolic shaped cross section;

a second elongated parabolic reflector extending below said second longitudinal axis, said second parabolic reflector having a substantially parabolic shaped cross section;

a first elongated kick reflector extending adjacent to a side of said lamp socket assembly along said first longitudinal axis; and a housing located under said first parabolic reflector, said second parabolic reflector, and said first kick reflector, said housing defining an open top of said indirect luminaire for allowing light to exit said luminaire.

10. The indirect luminaire of claim 9 further comprising a third elongated parabolic reflector having a substantially parabolic shaped cross section and a top edge, wherein said first parabolic reflector further has a top edge, wherein said first parabolic reflector top edge is joined to said third parabolic reflector top edge to form a first elongated apex, and wherein said first parabolic reflector and said third parabolic reflector are positioned such that said first apex is parallel to and directly under said first longitudinal axis.

11. The indirect luminaire of claim 10 further comprising a fourth elongated parabolic reflector having a substantially parabolic shaped cross section and a top edge, wherein said second parabolic reflector further has a top edge, wherein said second parabolic reflector top edge is joined to said fourth parabolic reflector top edge to form a second elongated apex, and wherein said second parabolic reflector and said fourth parabolic reflector are positioned such that said second apex is parallel to and directly under said second longitudinal axis.

12. The indirect luminaire of claim 11 further having an intermediate reflector section having a flat, substantially horizontal reflective surface, said intermediate reflector section positioned between said third parabolic reflector and said fourth parabolic reflector.

13. The indirect luminaire of claim 9 wherein said housing further has a bottom wall, wherein said bottom wall has a first elongated translucent area, wherein said first translucent area is located to be in optical communication with said second longitudinal axis.

14. The indirect luminaire of claim 9 further having a second elongated kick reflector extending adjacent to a side of said lamp socket assembly along second longitudinal axis.

15. The indirect luminaire of claim 14 wherein said first parabolic reflector and said first kick reflector are in a spaced relationship whereby a first opening is formed therebetween, wherein said second parabolic reflector and said second kick reflector are in a spaced relationship whereby a second opening is formed therebetween, wherein said housing further has a bottom wall, wherein said bottom wall has a first elongated translucent area and a second elongated translucent area, wherein said first translucent area is located to be in optical communication with said second longitudinal axis through said second opening, and wherein said second translucent area is located to be in optical communication with said first longitudinal axis through said first opening.

* * * * *